US005486844A

United States Patent [19]

Randall et al.

[11] Patent Number: 5,486,844

[45] Date of Patent: Jan. 23, 1996

[54] METHOD AND APPARATUS FOR SUPERIMPOSING DISPLAYED IMAGES

[75] Inventors: Martin Randall, Santa Cruz; Paul Campbell, Berkeley; Douglas J. Gilbert, Livermore, all of Calif.

[73] Assignee: Radius Inc, Sunnyvale, Calif.

[21] Appl. No.: 190,731

[22] Filed: Feb. 1, 1994

Related U.S. Application Data

[63] Continuation of Ser. No. 876,758, May 1, 1992, abandoned.

[51] Int. Cl.[6] ..... G09G 5/00

[52] U.S. Cl. ..... 345/113; 345/190

[58] Field of Search ..... 340/734, 703, 340/721, 724, 725, 745, 723, 799, 798; 395/129, 135; 358/183, 22; 345/112, 113, 114, 115, 200, 185, 189, 190, 201

[56] References Cited

U.S. PATENT DOCUMENTS

| | | | |
|---|---|---|---|
| 4,528,636 | 7/1985 | Robinson | 395/129 |
| 4,641,255 | 2/1987 | Hohmann | 358/183 |
| 4,682,297 | 7/1987 | Iwami | 358/183 |
| 4,752,893 | 6/1988 | Guttag et al. | 340/798 |
| 4,907,086 | 3/1990 | Truong | 340/734 |
| 5,179,642 | 1/1993 | Komatsu | 395/135 |

FOREIGN PATENT DOCUMENTS

431845A2 6/1991 European Pat. Off. ..... G09G 1/16

*Primary Examiner*—Richard Hjerpe
*Assistant Examiner*—Chanh Nguyen
*Attorney, Agent, or Firm*—Limbach & Limbach

[57] ABSTRACT

A method and apparatus for performing transparent data transfer operations on graphics data (such as video data), in which a source image currently displayed as part of a destination image (or stored in memory) is moved to a selected destination location on the destination image without obliterating background portions of the destination image. In a class of embodiments, the invention accomplishes a transparent bit-block transfer by clocking out source data (stored in an internal memory) to a bank of arithmetic logic units (ALUs), and processing the source data in the ALUs to identify portions of the source data representing transparent (or background) data which should not replace corresponding destination data, and which represent foreground data (new text to replace destination data). The marked source data are selectively written into a video memory containing the destination data, to selectively overwrite only those destination data pixels corresponding to new text. Transfers of source data to individual video memory locations which correspond transparent (background) data are inhibited or aborted.

2 Claims, 3 Drawing Sheets

METHOD AND APPARATUS FOR SUPERIMPOSING DISPLAYED IMAGES

This is a continuation of application Ser. No. 07/876,758 filed on May 1, 1992, now abandoned.

FIELD OF THE INVENTION

This invention relates to methods and apparatus for controlling a graphical display, such as a graphical video display. More particularly, the invention relates to methods and apparatus for superimposing source or pattern data on a graphical display, such as a graphical video display.

DESCRIPTION OF THE RELATED ART

A video graphics system typically includes a display monitor, a video memory, and control circuitry. Typical display monitors are comprised of an array of pixels that are illuminated by an electron beam. The video memory contains the data necessary to instruct the electron beam relative to the illumination of each pixel. The control circuitry is responsible for transferring the correct data from video memory to each pixel on the display.

Each pixel is defined by some number of bits (typically, one, eight, or twenty-four bits). A single bit per pixel is typical for monochromatic displays, and multiple bits per pixel are typical for high-resolution and color displays. By changing the values assigned to these bits, the shape, shading and color of the displayed image may be altered.

The pixels that represent an image currently displayed by a graphics system are stored in a bit-map memory, sometimes referred to as a Video Random Access Memory (VRAM). Each memory location in a VRAM has a unique address, allowing control circuitry to selectively write or read a set of bits (typically four bits) to or from each memory location.

In addition to a memory address, there are two control signals that must be activated before data can be written to or read from video memory. These control signals are the column address strobe (CAS) and the row address strobe (RAS).

Standard VRAM circuits typically store no more than four bits of data at each single memory address. Because the data defining a single pixel commonly comprise eight or more bits, a video graphics system typically includes multiple VRAM circuits. Use of multiple memory components (VRAM circuits) allows more than one pixel to be accessed during a single memory cycle.

In a conventional Apple Macintosh computer, the video memory is arranged as a matrix of "n" number of rows and "m" number of columns. Each memory location contains only four bits, and so the system must access several memory locations in order to transfer each pixel. Where a pixel is defined by eight bits, eight VRAMs need to be accessed simultaneously in order to transfer four pixels. To accomplish this, the VRAMs are controlled are controlled by common RAS and CAS signals, so that all eight VRAM components may be written or read as a group.

Video graphics systems conventionally offer a variety of ways to change the data that comprise an image. Some of these ways include: moving images from one position on the display to another (a bit-block transfer), filling an area of the display with a predetermined pattern (a pattern operation) such as a particular color, and expanding single-bit monochrome data to eight or twenty-four bits in order, for example, to convert the data to color (an expand operation). In each of these operations, the data being moved are referred to as "source data" (and can correspond to a "source image"), and the image on which the source data are to be written is referred to as the "destination image" (which corresponds to "destination data").

During a basic data transfer (a basic bit-block transfer, a basic pattern operation, or a basic expand operation), a graphics system reads source data from memory and writes it to the memory location of the original destination data. The updated video information (source data) completely overwrites the original pixel data (destination data), completely obscuring the overwritten portion of the original destination image. To implement a basic bit-block transfer, a conventional graphics system requires two memory access cycles: one to read the destination data from VRAM; and a second to write the updated destination data (completely overwritten by a block of source data) back into VRAM. To implement a basic pattern operation, a conventional graphics system requires a single memory access cycle: to write an internally-stored source data block into the destination in VRAM.

Many applications require that a different type of data transfer be conducted so that the destination image is not completely obscured by a block of source data. For example, it is often desired to have a destination image appear to lie "behind" or "underneath" a source image. This type of transfer is known conventionally as a "transparent" data transfer. An example of a conventional transparent data transfer is a transparent bit-block transfer, which overlays text (source data) on a colored or patterned background (destination data) without completely obscuring the colored or patterned background.

To perform a conventional transparent data transfer (e.g., a transparent bit-block transfer of text or other source data in which a background image remains visible behind the source data), a graphics system must selectively update the pixels of the destination image. Only pixels that are to be written with the foreground color (i.e., with the text or other source data) are updated. Pixels to be displayed in the background color are not updated.

Conventional graphics systems typically perform this selective updating operation by reading both the source data and the destination data from VRAM and temporarily storing them in an internal memory. Background data (usually representing a single source image pixel) are also stored in the internal memory, and the source data are compared with the background data using a bank of arithmetic logic units (ALUs). If the comparison results in a match, the relevant source data are not overwritten on the corresponding destination data stored in internal memory (leaving that destination data unchanged). If the comparison yields no match (i.e., the source and background data have different values), the relevant source data are written over the corresponding destination data in the internal memory. Finally, the updated destination data are written from the internal memory back into the original destination area in VRAM. This conventional method of performing a transparent bit-block transfer requires three memory accesses: one to read the source data, a second to read the destination data, and a third to write the updated destination data back to VRAM.

From the previous paragraph, it will be apparent that performance of a transparent bit-block transfer (using a conventional graphics system) requires one more memory access than performance of a corresponding basic bit-block transfer (in which destination data is not read into an internal memory, and in which an entire block of destination data in VRAM is completely obliterated by being overwritten with a block of source data). Such an extra memory access operation is also required to implement a conventional transparent pattern or transparent expand operation.

Until the present invention, it was not known how to implement a transparent data transfer in a manner requiring no more memory access cycles than a corresponding basic data transfer.

SUMMARY OF THE INVENTION

The present invention is a method and apparatus enabling a graphics system to perform various data transfers, including transparent data transfers, with increased speed. The inventive apparatus includes an "accelerator circuit" ("accelerator") with "Source OR" ("srcOR") circuitry which allows transparent data transfers to be performed with the same number of memory access operations as required to perform conventional basic data transfers. The invention enables performance of a transparent bit-block transfer in two-thirds the time required by a conventional graphics system to do so, and performance of transparent pattern and expand operations in only half the time required by a conventional graphics system to do so.

The inventive method for performing a transparent bit-block transfer includes the steps of clocking out source data (stored in internal memory within an accelerator circuit) to a bank of arithmetic logic units (ALUs), and processing the source data in the ALUs to determine which of the source data represent "transparent" data (which should not replace corresponding destination data) and which represent foreground data ("new text" which is to replace destination data). The source data are compared to background data (representing a single pixel) also stored in internal memory within the accelerator circuit, and the source data which do not match the background data (i.e., the source data which represent new text) are marked with a "miss" indication) or are not marked. The source data which matches the background data are moved to the outputs of the ALUs are marked with a "match" indication. The marked data can then be rotated or shifted for correct alignment with data lines on a system bus. The marked data (which may also have been realigned or shifted) is passed through a bank of multiplexers and loaded into a set of pipeline registers. The pipeline registers drive the data onto the system bus and to the VRAMs.

Not all the marked data present at the pipeline register outputs are transferred to the VRAMs. Instead, the invention accelerates data transfer to the VRAMs by enabling the VRAMs for only those marked pixels representing updated pixel information (new text). Transfers to VRAM locations which correspond to "transparent" (or "background") data are inhibited or aborted. This is accomplished by generating individual column address strobe (CAS) lines to control individual VRAMs or sets of VRAMs (i.e., individual pairs of VRAMs corresponding to pixels) rather than common lines which control all the VRAMs as a group.

DETAILED DESCRIPTION OF THE PREFERRED EMBODIMENTS

Figure 1:
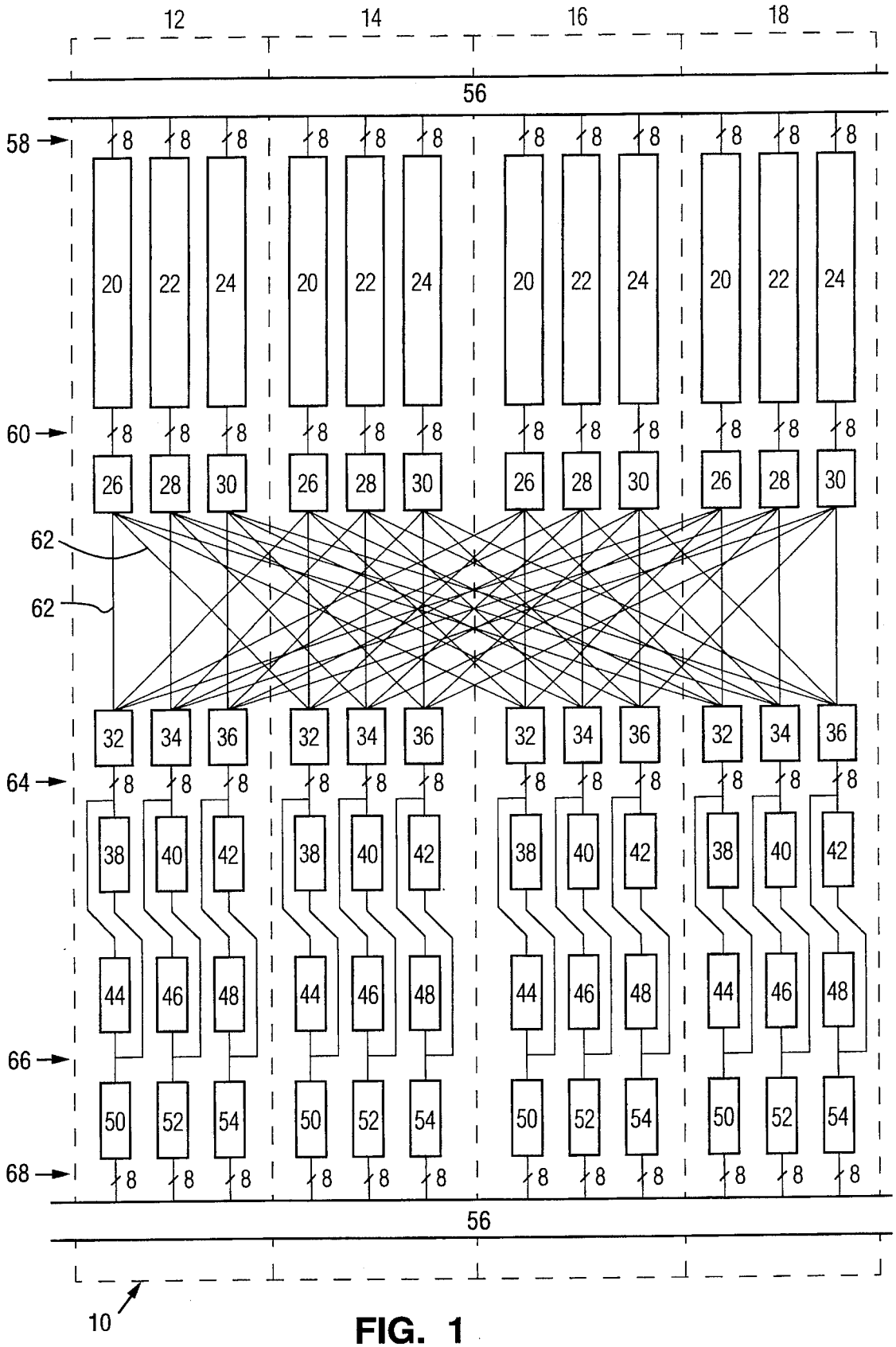
FIG. 1 is a block diagram of an accelerator circuit used in a preferred embodiment of the invention.
Figure 3:
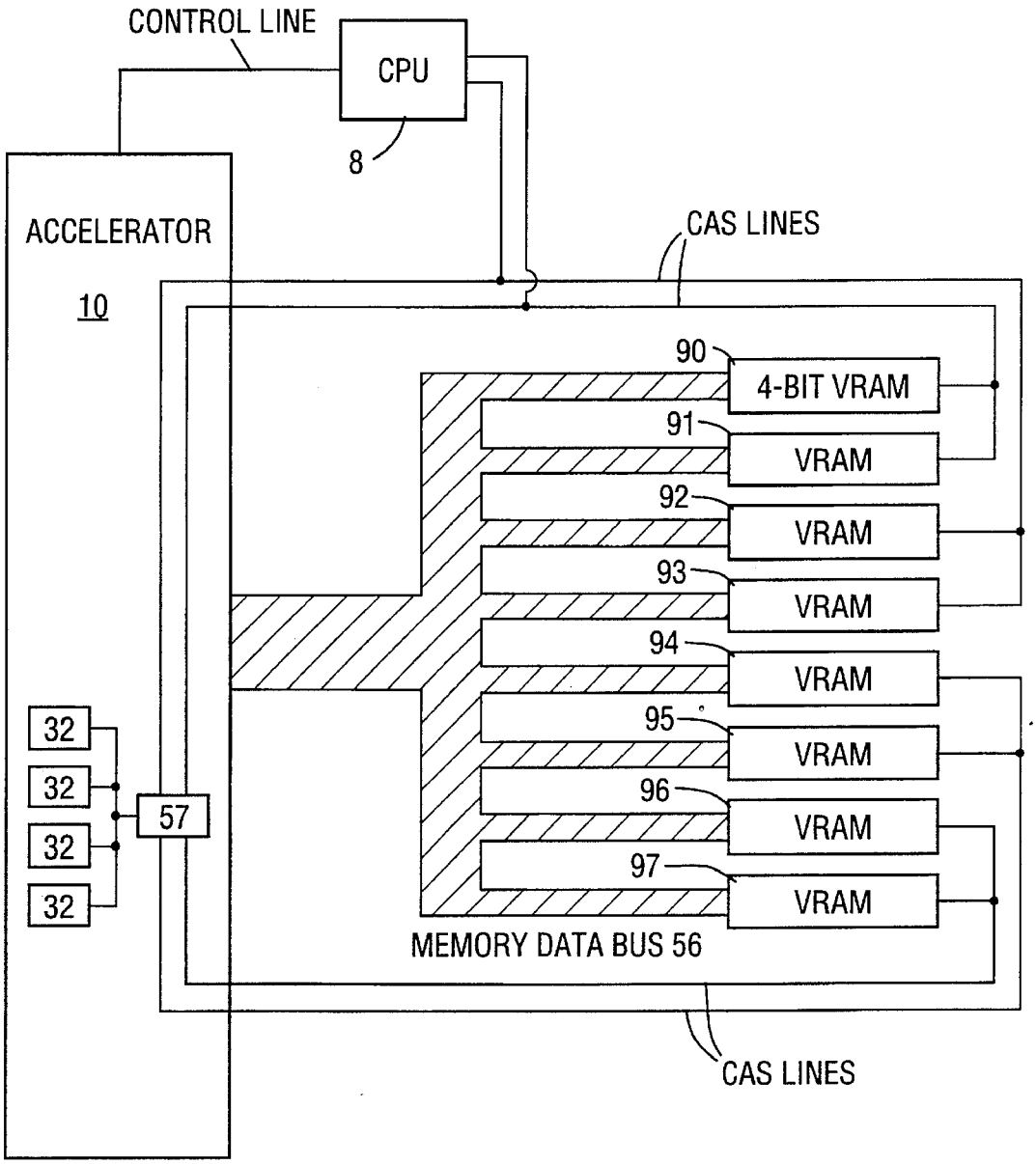
FIG. 3 is a block diagram of a preferred embodiment of the invention.

FIG. 1 is a preferred embodiment of the accelerator circuit 10 of the invention, which is shown as a block in FIG. 3. Circuit 10 performs the data transfers required to implement bit-block, pattern, and expand operations. In one preferred implementation, circuit 10 is a custom gate array which works in conjunction with a commercially available model SMT02 video controller and a commercially available BSR03 shift register to accelerate these data transfers. Circuit 10 includes internal memory (SRAM circuits 20, 22, and 24), arithmetic logic circuits (ALUs 26, 28, and 30), multiplexers 32, 34, and 36, and pipeline registers 38–54.

Circuit 10 is preferably designed to be compatible with the video memory operations of a conventional Apple Macintosh computer. Alternatively, the present invention may be practiced on other computers having video memory operations similar to those of conventional Apple Macintosh computers.

As shown in FIG. 1, circuit 10 consists of four identical pixel modules 12, 14, 16, and 18. Each pixel module includes three identical input memory registers (SRAMs 20, 22, and 24 ) , three identical ALUs 26, 28, and 30, three identical multiplexer units 32, 34, and 36, three identical first output registers 38, 40, and 42, three identical second output registers 44, 46, and 48, three identical output buffer registers 50, 52, and 54, logic and control circuitry (not shown), and video memory enable lines (shown in FIG. 3, but not in FIG. 1 or 2).

Within each pixel module 12, 14, 16, and 18, each of input memory registers 20-24 is implemented by a 32×8 bit register, and the three input memory registers 20–24 are configured in a 32×24 bit array. Each of input memory registers 20–24 is electrically connected to a video memory data bus 56 by a first parallel data line 58.

Each of ALUs 26–30 is eight bits wide and is electrically connected to one of the input memory units 20–24 by a second parallel data line 60. Each of ALUs 26–30 includes a foreground register also referred to as "source register" (not shown in FIG. 1), a background register (not shown in FIG. 1), and a match register (not shown in FIG. 1). Each source register stores an eight bit source word and each background register stores an eight bit background word.

Each of multiplexer units 32–36 is eight bits wide, and is electrically connected to one of the ALUs 26–30 by a third parallel data line 62. In addition, each multiplexer unit 32–36 is electrically connected to a corresponding ALU in each of the remaining pixel modules, 12, 14, 16, and 18.

For example, multiplexer unit 32 of pixel module 18 is connected to the ALU 26 in pixel module 18, and also to the ALUs 26 in pixel modules 12, 14, and 16. Data paths between all the ALUs 26–28 and all the multiplexer units 32–36 are shown in FIG. 1. Some of these data paths are omitted from FIG. 2, to represent an operating mode (or configuration) of circuit 10 in which only one ALU per pixel module is utilized.

Each first output register 38, 40, and 42, and each second output register 44, 46, and 48, is eight bits wide. Each of the multiplexer units 32–36 is electrically connected to one of the first output registers by a fourth parallel data line 64 and to one of the second output registers by a fifth parallel data line, each first output register is electrically connected to one of the buffer registers 50–54 by a sixth parallel data line, and each second output register is electrically connected to one of the buffer registers 50–54 by a seventh parallel data line 66. Each of buffer register 50, 52, and 54, is eight bits wide and is electrically connected to the video memory data bus 56 by an eighth parallel data line 68.

The control circuitry and the video memory enable lines (the CAS lines shown in FIG. 3) of circuit 10 are configured so that circuit 10 can individually enable each VRAM circuit (each of identical four-bit VRAM circuits 90–97 shown in FIG. 3).

Preferably, each of pixel modules 12–18 can be configured to accept pixel words having the appropriate word length (i.e., eight or 24 bit words per pixel) in response to appropriate control signals received from a computer 8 (shown in FIG. 3). If each source image pixel is represented by eight bits, then circuit 10 will be configured so that only the first registers and units (input memory register 20, ALU 26, multiplexer unit 32, and buffer register 50) will be utilized in each pixel module 12–18. If each pixel is represented by 24 bits, then all of the registers and units of each pixel module 12–18 will be utilized by circuit 10.

To perform a transparent bit-block transfer using circuit 10, the user designates source, destination, and background data addresses using conventional methods. The source, destination, and background data addresses are used by the FIG. 3 system to write source data into internal memory circuits 20, 22, and 24 within circuit 10 (in a conventional manner).

During each memory cycle, circuit 10 will transfer, in scan-line order, source data representing four source pixels from the video memory to the configured input memory registers 20–24 of the four modules 12–18, via video memory data bus 56.

After source data representing four pixels has been transferred to the input memory registers 20–24, circuit 10 will then pass the source data through the ALUs 26–30 of each pixel module 12–18.

As the source data passes through each ALU, the source data are compared to the background data stored in the background register of the ALU. If the source data matches the background data, the source data is marked (tagged) to indicate a match (with the background color). Otherwise, the source data is not marked (or is marked as a "miss").

Figure 2:
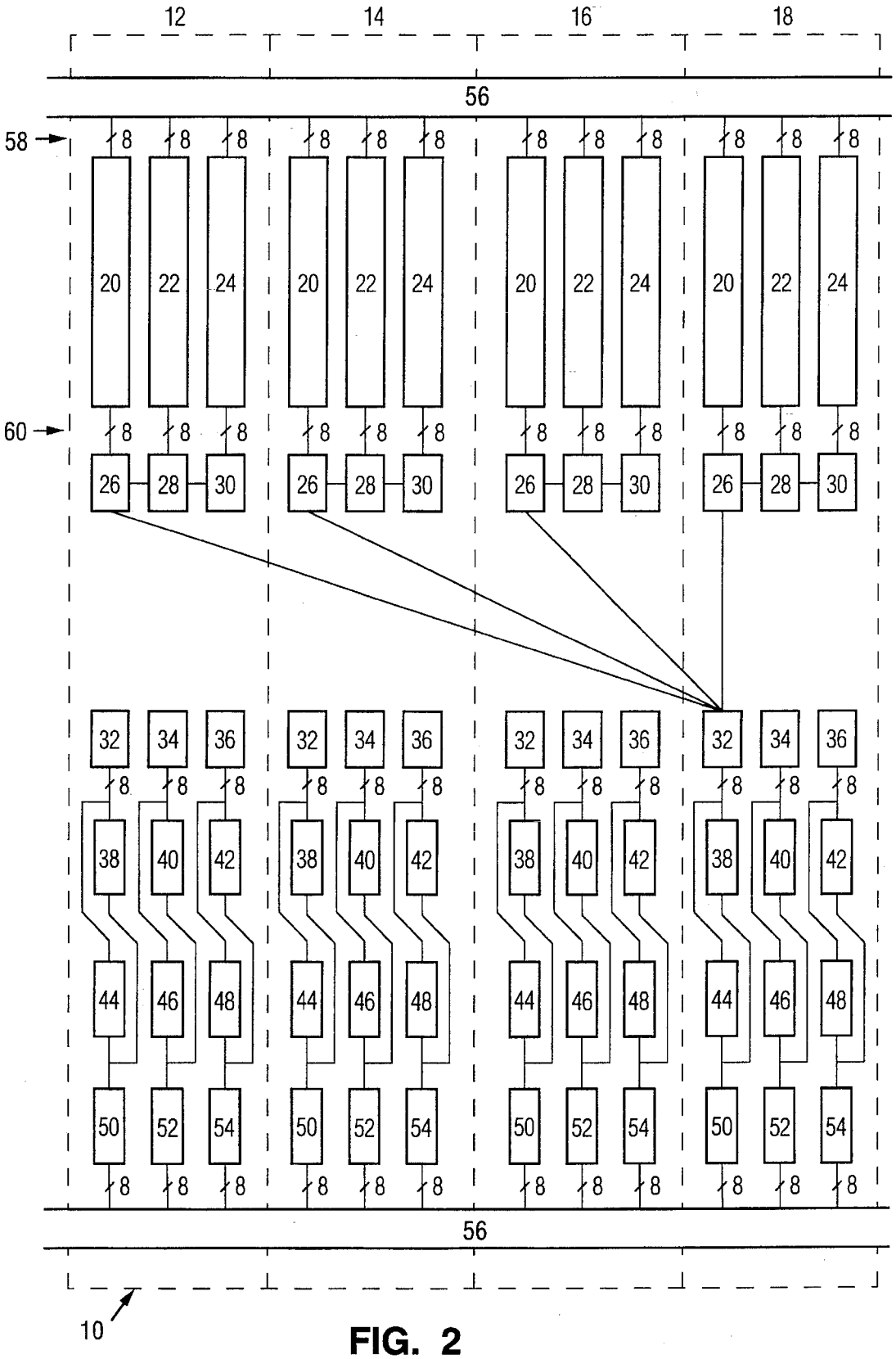
FIG. 2 is another block diagram of FIG. 1 circuit, representing a mode of operation in which a multiplexing unit in a first one of pixel modules 12, 14, 16, and 18 receives marked source data from an arithmetic logic unit in any of the pixel modules.

Next, the marked source data (portions of which may not be marked) are transferred from each of ALUs 26–30 to the multiplexers 32–36 of any selected one of the pixel modules 12–18 (as suggested by FIG. 1). Of course, if circuit 10 is configured for eight-bit pixels so that only one memory 20 and one ALU 26 are utilized within each pixel module, source data from each of the ALUs 26 are transferred to a selected one of the multiplexers 32 (in the same pixel module or a different pixel module). As indicated in FIG. 2, the marked source data from any of four ALUs 26 can be transferred to multiplexer 32 within pixel module 18.

The source data are then transferred from each of multiplexers 32, 34, 36 to the first output register 38, 40, or 42 (or the second output register 44, 46, or 48) connected thereto. From registers 38, 40, and 42 (or registers 44, 46, and 48), the source data are transferred to buffer registers 50, 52, and 54 within each pixel module 12–18.

Once the marked source data has been transferred to the buffer registers 50, 52, and 54, said data is selectively written into the VRAMs (via bus 56) to update the destination data stored in the VRAMs. This is accomplished by processing the marked source data to generate individual column address strobe (CAS) signals for selectively enabling only the writing of source data representing new text (i.e., only unmarked source data or source data marked with a "miss" indication) to the individual VRAMs or sets of VRAMs storing corresponding destination data (e.g, to each appropriate pair of four-bit VRAMs 90–97 which stores an eight-bit pixel, in the FIG. 3 embodiment). In one embodiment, the marked source data from units 32 (or from all of units 32, 34, and 36, although units 34 and 36 are not shown in FIG. 3) are processed in CAS signal generation circuit 57 shown in FIG. 3 to generate CAS signals therefrom. The CAS signals are asserted at the outputs of circuit 57, through individual CAS lines, to pairs of VRAMs 90–97 to selectively enable and disable appropriate ones of such pairs of VRAMs 90–97. In this way, only those destination data pixels in the VRAMs which correspond to new text (i.e., source data not marked to indicate a match with background data) are overwritten with source data. The CAS signals prevent transfers of source data to locations within the VRAMs corresponding to "transparent" or "background" data (i.e., source data marked to indicate a match with background data).

All of the source data is presented to the video memory (i.e., stored in registers 50–52) in the same manner as it would be if circuit 10 were controlled to perform a conventional basic (non-transparent) data transfer.

Referring again to FIG. 2, marked source data asserted at the outputs of ALUs 26–28 can be rotated, re-aligned, or shifted by transferring source data from ALU 26 (or all of ALUs 26–28) in a given pixel module to a multiplexer 32, 34, or 36 (or combination of multiplexers 32–36) in a different pixel module.

To perform a transparent pattern operation using the FIG. 3. system, the user designates a destination image, for example, by outlining the destination image on the screen of a display terminal. The user then selects a predetermined pattern to be transferred (typically, by selecting a displayed pattern image), and a background pixel within the pattern image. A computer system (such as computer 8 shown in FIG. 3) generates destination addresses identifying which VRAM memory locations contain destination data representing the destination image, and pattern addresses representing memory locations containing pattern data representing the pattern.

During each succeeding memory cycle, circuit 10 will transfer pattern data representing four pattern image pixels into one or more of memory circuits 20, 22, and 24. During each memory cycle, circuit 10 will also transfer pattern data representing four pattern pixels from memory registers 20, 22, and 24, to ALUs, 26, 28, and 30 connected thereto.

Following this, in each ALU, the pattern data are compared to the background data stored in a background register. If the pattern data matches the background data, the pattern data is marked (tagged) to indicate a match (with the background color). Otherwise, the pattern data is not marked (or is marked as a "miss").

Next, the marked pattern data are transferred from each of ALUs 26–30 to multiplexers 32–36 within any selected one of the pixel modules 12–18, and the marked pattern data are thereafter processed in the same manner as marked source data in the above-described transparent bit-block transfer operation.

All of the marked pattern data is presented to the video memory in the same manner as it would be when performing a non-transparent pattern operation. However, just as in the above-described transparent bit-block transfer operation, circuit 10 selectively enables the VRAMs to receive only those pattern data pixels that contain updated pixel information (i.e., those pattern data pixels not marked to indicate a match with background data). Only those destination data pixels in the VRAMs which correspond to pattern data not marked to indicate a match with background data are overwritten with pattern data. CAS signals prevent the transfer of pattern data to VRAM locations corresponding to "transparent" or "background" data (i.e., pattern data marked to indicate a match with background data), so that the destination data in these VRAM locations are not overwritten.

Since circuit 10 need not read destination data from the VRAMs to perform a transparent pattern operation, it can perform a transparent pattern operation in substantially the same time as it requires to perform a non-transparent (basic) pattern operation.

Circuit 10, with individual CAS lines as shown in FIG. 3, allows a transparent data transfer to be done as quickly as a corresponding basic data transfer. The invention eliminates the need to read destination data into an internal memory in order to perform a transparent data transfer, allowing the system to omit one of the three memory cycles normally associated with a transparent data transfer.

In the claims, the term "source data" is employed in a broad sense, to include source data of the type described above with reference to transparent bit-block transfers, pattern data of the type described above with reference to transparent pattern operations, and also data for replacing selected destination image pixels in other transparent data transfer operations (including transparent expand operations). In the claims, the expressions "destination data" and "video memory" are used in a broad sense to denote, respectively, any type of graphics data (such as, but not limited to, video data) and any random access memory for storing graphics data (such as, but not limited to, VRAM circuits). In the claims, the operation of "marking" source data denotes any of a wide variety of techniques for distinguishing a first type of source data portions from a second type of source data portions, including insertion of marking data only in each portion of the first type, insertion of marking data only in each portion of the second type, and insertion of a first type of mark in each portion of the first type and a second type of mark in each portion of the second type.

Various modifications and alterations in the structure and method of operation of the invention will be apparent to those skilled in the art without departing from the scope and spirit of this invention. Although the invention has been described in connection with specific preferred embodiments, it should be understood that the invention as claimed should not be unduly limited to such specific embodiments.

What is claimed is:

1. A system for performing a transparent data transfer operation on a destination image comprised of destination pixels stored in a video memory, without reading any of the destination pixels from the video memory, including:

an internal memory for storing source pixels and background data, wherein the source pixels consist of foreground source pixels and background source pixels, and each of the source pixels corresponds with one of the destination pixels, and wherein the internal memory stores none of the destination pixels;

comparison and identification means for comparing the source pixels stored in the internal memory with the background data stored in the internal memory, and identifying each of said source pixels as a foreground source pixel or a background source pixel as a result of such comparison; and means for writing only those source pixels identified as foreground source pixels to the video memory to substitute the source pixels identified as foreground source pixels for the destination pixels corresponding to said source pixels identified as foreground source pixels, wherein said means for writing includes means for generating a column address strobe signal for the video memory and selectively asserting said column address strobe signal to a first control line so as to disable transfers of the source pixels identified as background pixels to said video memory, thereby preventing said source pixels identified as background pixels from overwriting any of said destination pixels, wherein the comparison and identification means receives parallel streams of the source pixels and said comparison and identification means includes:

at least two banks of arithmetic logic units, each of said banks connected to receive a different one of the streams of the source pixels, said banks outputting parallel marked source pixel streams, each of the marked source pixel streams including source pixels of one of the streams of the source pixels, and marking data identifying each of the source pixels in said one of the streams of the source pixels as a foreground source pixel or a background source pixel, each of said banks including means for comparing each of the source pixels in said one of the streams with said background data, identifying said each of the source pixels in said one of the streams as a foreground source pixel or a background source pixel, and generating said marking data for said one of the streams;

at least one set of multiplexers, each of said multiplexers receiving source pixels from at least two of the marked source pixel streams and selectively combining said received source pixels into a multiplexed source pixel stream; and a set of pipelined registers for receiving each said multiplexed source pixel stream from the multiplexers and asserting each said received multiplexed source pixel stream to a data bus coupled to the video memory.

2. The system of claim 1, wherein the comparison and identification means receives four parallel streams of the source pixels, and wherein the comparison and identification means includes:

four banks of arithmetic logic units connected in parallel, each of said banks connected to receive a different one of the streams of the source pixels; and four sets of multiplexers connected in parallel, each multiplexer in each of the sets of multiplexers receiving source pixels from four parallel marked source pixel streams, each of said four parallel marked source pixel streams including one marked source pixel stream from each of the banks of arithmetic logic units.

* * * * *